US011443572B2

(12) United States Patent
Kusanale et al.

(10) Patent No.: US 11,443,572 B2
(45) Date of Patent: Sep. 13, 2022

(54) ELECTRONIC LOCK WITH CLUTCH

(71) Applicant: Schlage Lock Company LLC, Carmel, IN (US)

(72) Inventors: Vishal Salitkumar Kusanale, Bangalore (IN); Mahesha Appaji, Bengaluru (IN); Rakshith R. Nayak, Mysuru (IN); Vijayakumar Mani, Bangalore (IN); Aaron P. McKibben, Fishers, IN (US)

(73) Assignee: Schlage Lock Company LLC, Carmel, IN (US)

( * ) Notice: Subject to any disclaimer, the term of this patent is extended or adjusted under 35 U.S.C. 154(b) by 457 days.

(21) Appl. No.: 16/705,343

(22) Filed: Dec. 6, 2019

(65) Prior Publication Data

US 2021/0174620 A1 Jun. 10, 2021

(51) Int. Cl.

| | |
|---|---|
| ***G07C 9/00*** | (2020.01) |
| ***E05B 47/00*** | (2006.01) |
| ***E05B 47/06*** | (2006.01) |

(52) U.S. Cl.

CPC ..... *G07C 9/00722* (2013.01); *E05B 47/0012* (2013.01); *E05B 47/068* (2013.01);

(Continued)

(58) Field of Classification Search

CPC ..... G07C 9/00722; G07C 2009/00626; E05B 47/0012; E05B 2047/0084; E05B 17/0054;

(Continued)

(56) References Cited

U.S. PATENT DOCUMENTS 3,791,180 A * 2/1974 Doyle ..... E05B 59/00 292/34
4,011,741 A * 3/1977 Nolin ..... E05B 59/00 70/462

(Continued)

FOREIGN PATENT DOCUMENTS

DE 3606531 A1 * 9/1987 ..... E05B 47/0012
EP 0364878 A2 * 4/1990 ..... E05B 47/0012

(Continued)

*Primary Examiner* — Kristina R Fulton
*Assistant Examiner* — Tal Saif
(74) *Attorney, Agent, or Firm* — Taft Stettinius & Hollister LLP

(57) ABSTRACT

A lockset including a bolt mechanism, an exterior assembly, an interior assembly, a driving tailpiece, and a driven tailpiece. The bolt assembly includes a bolt having an extended position and a retracted position. The exterior assembly includes a rotatable exterior manual actuator. The interior assembly includes a clutch having a coupling state and a decoupling state. The driving tailpiece is connected between the exterior manual actuator and the clutch. The driven tailpiece is connected between the clutch and the bolt mechanism such that rotation of the driven tailpiece actuates the bolt assembly. In the coupling state, the clutch couples the driving tailpiece with the driven tailpiece such that the exterior manual actuator is operable to actuate the bolt assembly. In the decoupling state, the clutch decouples the driving tailpiece from the driven tailpiece such that the exterior manual actuator is inoperable to actuate the bolt assembly.

25 Claims, 8 Drawing Sheets

(52) U.S. Cl.
CPC ..... *E05B 2047/002* (2013.01); *E05B 2047/0026* (2013.01); *E05B 2047/0084* (2013.01); *G07C 2009/00626* (2013.01)

(58) Field of Classification Search
CPC .... E05B 17/044; E05B 17/045; E05B 17/046; E05B 47/0638; E05B 47/0642; E05B 47/0676; E05B 47/068; E05B 2047/0018; E05B 2047/002; E05B 2047/0026; E05B 2047/0028; E05B 2047/003; E05B 2047/0031; E05B 13/00; E05B 13/04; E05B 15/0033; E05B 47/00; E05B 17/042; Y10T 70/5416; Y10T 70/5496; Y10T 70/7102; Y10T 70/7107; Y10T 70/7113; Y10T 70/7119; Y10T 70/7124
USPC ..... 70/91, 190, 279.1, 277, 27, 8.1, 278.7, 70/280, 281, 282, 283, 468, 472; 292/137, 139, 143, 169; 340/5.54, 5.64, 340/5.7; 341/122
See application file for complete search history.

(56) References Cited

U.S. PATENT DOCUMENTS

| | | | | | |
|---|---|---|---|---|---|
| 4,438,962 | A * | 3/1984 | Soloviff | E05B 47/0012 | 292/144 |
| 5,477,041 | A * | 12/1995 | Miron | G07C 9/29 | 340/5.6 |
| 5,946,955 | A * | 9/1999 | Suggs | E05B 47/068 | 70/218 |
| 8,141,400 | B2 * | 3/2012 | Sorensen | E05B 47/068 | 70/277 |
| 8,176,761 | B2 | 5/2012 | Sorensen et al. | | |
| 2007/0051145 | A1 * | 3/2007 | Chang | E05B 13/108 | 70/279.1 |
| 2011/0259059 | A1 * | 10/2011 | Wu | E05B 63/0017 | 70/91 |
| 2016/0258189 | A1 * | 9/2016 | Frolov | E05B 63/08 | |

FOREIGN PATENT DOCUMENTS

| | | | | |
|---|---|---|---|---|
| GB | 2568730 | A * | 5/2019 | E05B 47/0012 |
| WO | WO-2012122697 | A1 * | 9/2012 | E05B 13/004 |

* cited by examiner

ELECTRONIC LOCK WITH CLUTCH

TECHNICAL FIELD

The present disclosure generally relates to locksets, and more particularly but not exclusively relates to electronic deadbolt locksets.

BACKGROUND

Electronic deadbolt locksets are occasionally installed to doors to permit a user on the outside of the door to selectively retract a deadbolt to unlock the door. Current approaches to such electronic deadbolt locks suffer from a variety of drawbacks and limitations. For example, certain electronic deadbolt locksets place the motor and associated unlocking mechanism in the exterior assembly. This can render the exterior assembly bulkier and less aesthetically pleasing, and requires additional parts to ensure the security of the lockset. For these reasons among others, there remains a need for further improvements in this technological field.

SUMMARY

An exemplary lockset generally includes a bolt mechanism, an exterior assembly, an interior assembly, a driving tailpiece, and a driven tailpiece. The bolt assembly includes a bolt having an extended position and a retracted position. The exterior assembly includes a rotatable exterior manual actuator. The interior assembly includes a clutch having a coupling state and a decoupling state. The driving tailpiece is connected between the exterior manual actuator and the clutch. The driven tailpiece is connected between the clutch and the bolt mechanism such that rotation of the driven tailpiece actuates the bolt assembly. In the coupling state, the clutch couples the driving tailpiece with the driven tailpiece such that the exterior manual actuator is operable to actuate the bolt assembly. In the decoupling state, the clutch decouples the driving tailpiece from the driven tailpiece such that the exterior manual actuator is inoperable to actuate the bolt assembly. Further embodiments, forms, features, and aspects of the present application shall become apparent from the description and figures provided herewith.

DETAILED DESCRIPTION OF ILLUSTRATIVE EMBODIMENTS

Figure 1:
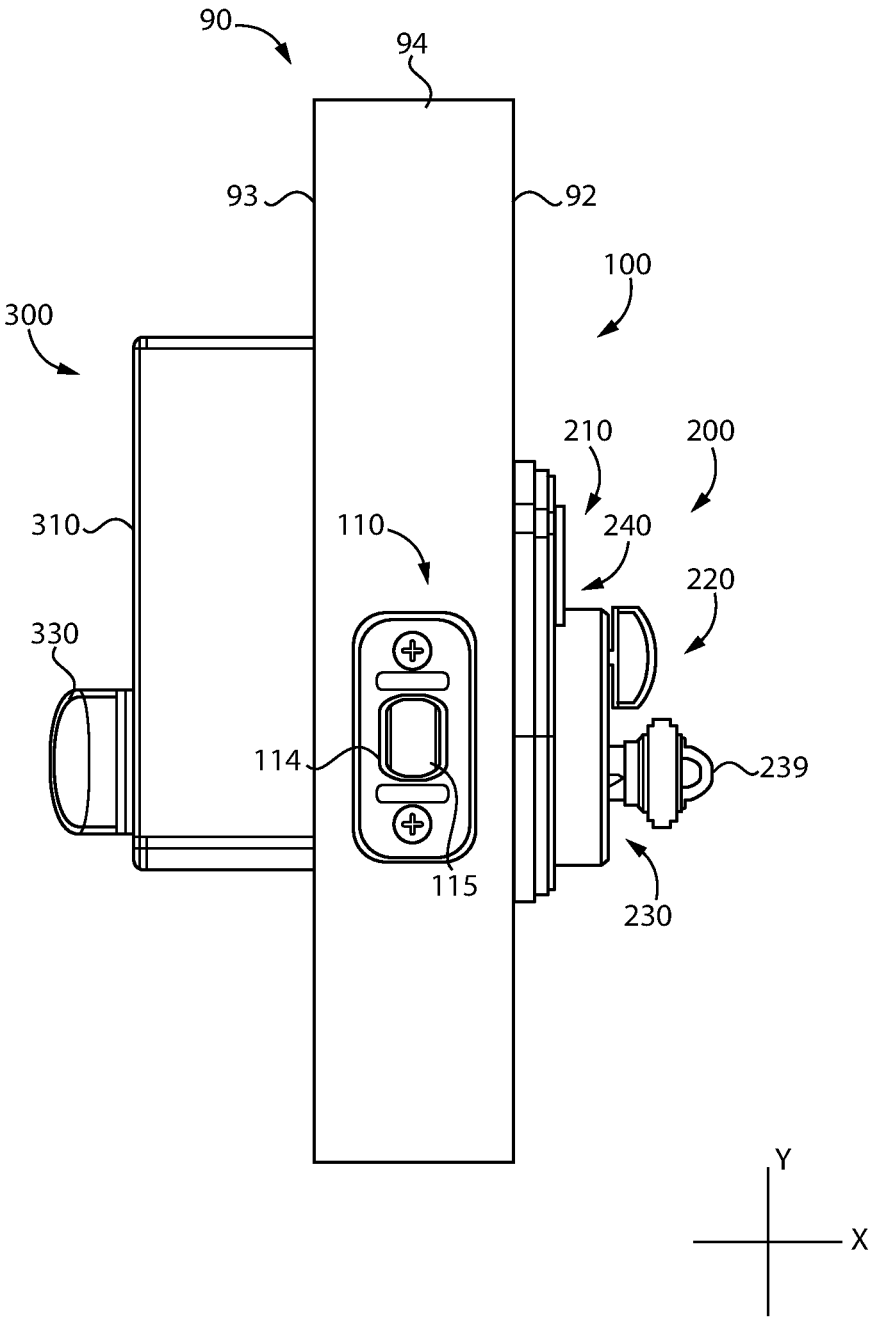
FIG. 1 is a side view of a lockset according to certain embodiments installed to a door.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

As used herein, the terms "longitudinal," "lateral," and "transverse" are used to denote motion or spacing along three mutually perpendicular axes, wherein each of the axes defines two opposite directions. In the coordinate system illustrated in FIG. 3, the X-axis defines first and second longitudinal directions, the Y-axis defines first and second lateral directions, and the Z-axis defines first and second transverse directions. These terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment. Furthermore, motion or spacing along a direction defined by one of the axes need not preclude motion or spacing along a direction defined by another of the axes. For example, elements that are described as being "laterally offset" from one another may also be offset in the longitudinal and/or transverse directions, or may be aligned in the longitudinal and/or transverse directions. The terms are therefore not to be construed as limiting the scope of the subject matter described herein to any particular arrangement unless specified to the contrary.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

The disclosed embodiments may, in some cases, be implemented in hardware, firmware, software, or a combination thereof. The disclosed embodiments may also be implemented as instructions carried by or stored on one or more transitory or non-transitory machine-readable (e.g., computer-readable) storage media, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

Figure 2:
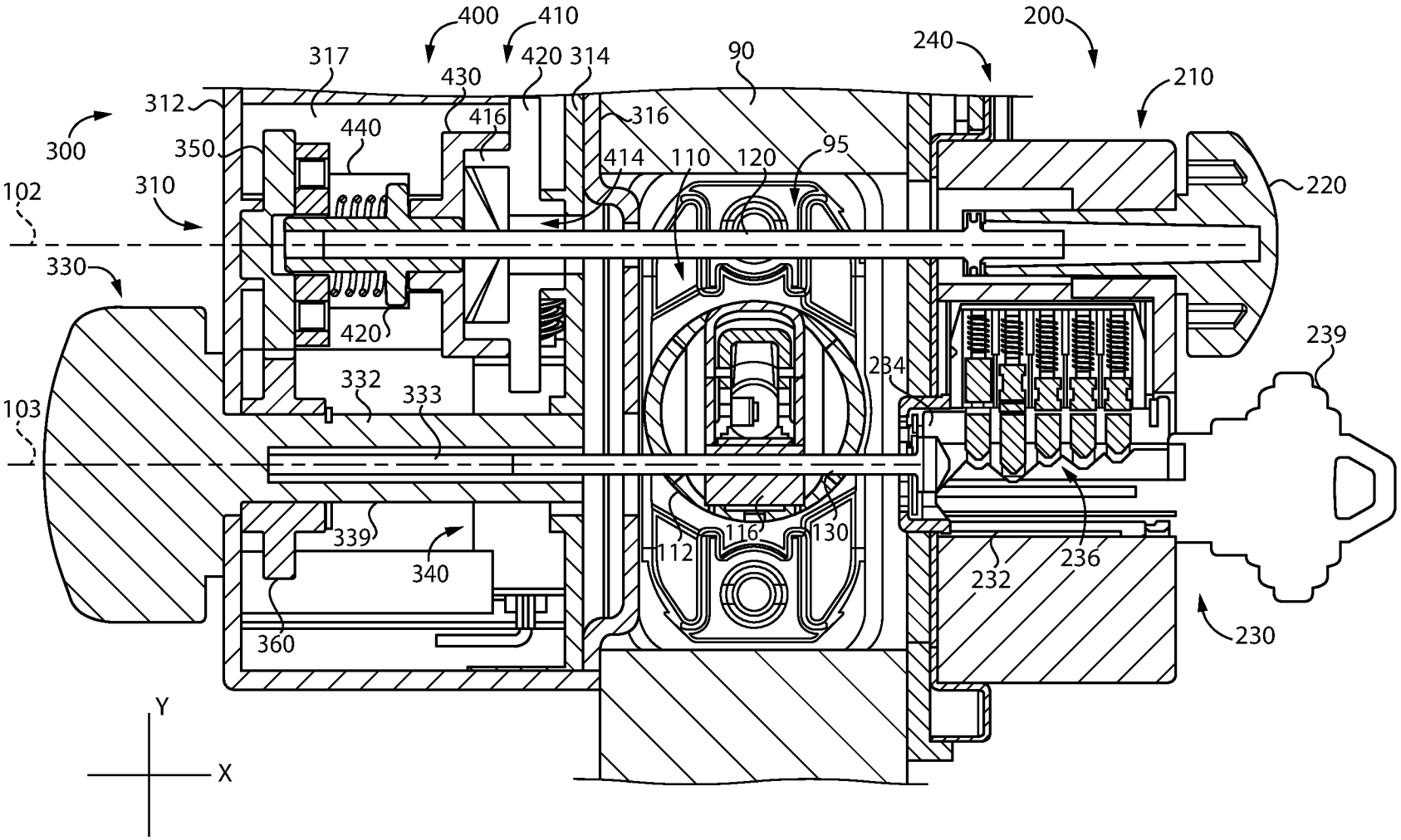
FIG. 2 is a cross-sectional view of the lockset illustrated in FIG. 1.

With reference to FIGS. 1 and 2, illustrated therein is a lockset 100 according to certain embodiments installed to a door 90. The door 90 has a non-egress or exterior side 92, an egress or interior side 93, a free edge 94 extending between and connecting the exterior side 92 and the interior side 93, a cross-bore 95 extending between the exterior side 92 and the interior side 93, and a latch bore extending from the cross-bore 95 to the free edge 94. The lockset 100 generally includes a bolt mechanism 110, a driving tailpiece 120 extending along a first longitudinal axis 102, a driven tailpiece 130 extending along a second longitudinal axis 103, an exterior assembly 200 mounted to the exterior side 92 of the door 90, and an interior assembly 300 mounted to the interior side 93 of the door 90.

The bolt mechanism 110 includes a housing 112, a bolt 114 movably mounted in the housing 112 for movement between an extended position and a retracted position, and a retractor 116 engaged with the bolt 114 and the driven tailpiece 130 such that rotation of the driven tailpiece 130 drives the bolt 114 between the extended position and the retracted position. In the illustrated form, the bolt mechanism 110 is provided as a deadbolt mechanism in which the bolt 114 is provided as a deadbolt with a substantially flat front face 115. In other embodiments, the bolt mechanism 110 may be provided as a latchbolt mechanism in which the bolt 114 is provided as a latchbolt that is biased toward the extended position and includes a tapered front face.

The driving tailpiece 120 extends through the cross-bore 95 along the first longitudinal axis 102. The driving tailpiece 120 is engaged with the exterior assembly 200 near the exterior side 92 of the door 90, and is engaged with the interior assembly 300 near the interior side 93 of the door 90. In the illustrated form, the driving tailpiece 120 is not directly engaged with the bolt mechanism 110. As described herein, however, the driving tailpiece 120 is selectively coupled with the driven tailpiece 130 such that the driving tailpiece 120 is selectively operable to actuate the bolt mechanism 110 by rotating the driven tailpiece 130.

The driven tailpiece 130 extends through the cross-bore 95 along the second longitudinal axis 103, is engaged with of the exterior assembly 200 near the exterior side 92 of the door 90, and is engaged with the interior assembly 300 near the interior side 93 of the door 90. The driven tailpiece 130 passes through the bolt mechanism 110 and is engaged with the retractor 116 such that rotation of the driven tailpiece 130 actuates the bolt mechanism 110 to drive the bolt 114 between its extended position and its retracted position.

Figure 3:
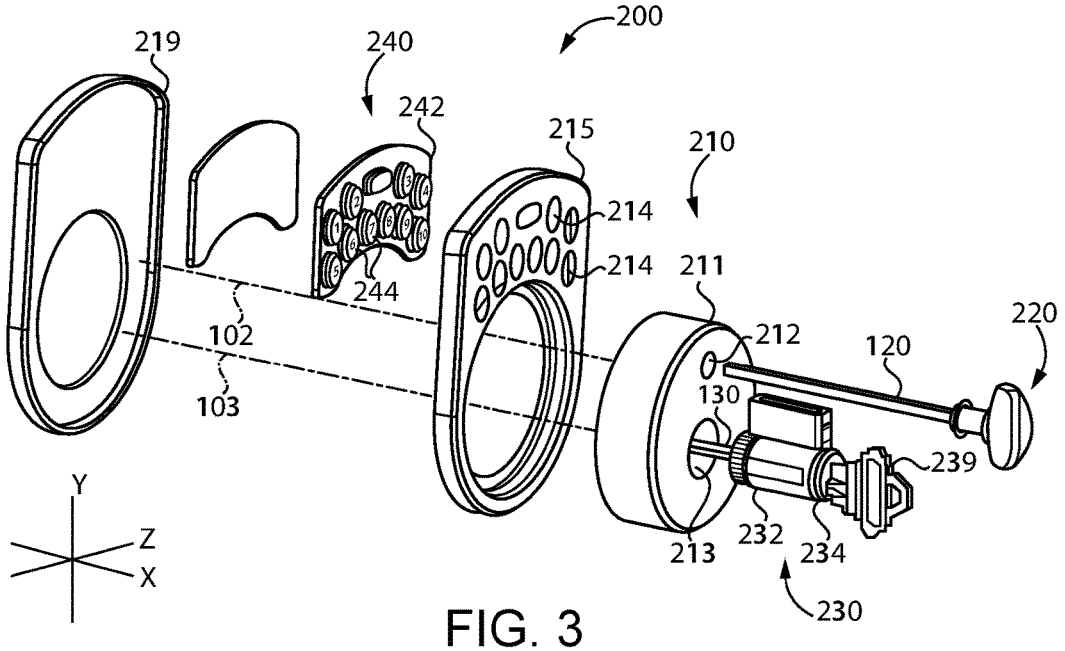
FIG. 3 is an exploded assembly view of an exterior assembly of the lockset illustrated in FIG. 1.

With additional reference to FIG. 3, the exterior assembly 200 generally includes an exterior escutcheon 210, an exterior manual actuator in the form of an exterior thumbturn 220 rotatably mounted to the escutcheon 210 and connected with the driving tailpiece 120, a lock cylinder 230 mounted to the escutcheon 210 and connected with the driven tailpiece 130, and a credential reader 240 mounted to the escutcheon 210.

The exterior escutcheon 210 generally includes a housing 211 and a plate 215 coupled with the housing 211. The illustrated housing 211 includes a first opening 212 in which the exterior thumbturn 220 is rotatably seated, and a second opening 213 in which the lock cylinder 230 is seated. The escutcheon 210 may include one or more windows or apertures 214 through which the credential reader 240 is accessible, and in the illustrated form the apertures 214 are formed in the plate 215. The escutcheon 210 may further include a seal member 219, which may be captured between the plate 215 and the exterior side 92 of the door 90 to discourage water and other contaminants from entering the escutcheon 210.

The exterior thumbturn 220 is rotatably mounted in the first opening 212, and is engaged with the driving tailpiece 120 such that rotation of the thumbturn 220 causes a corresponding rotation of the driving tailpiece 120. While other forms are contemplated, in the illustrated form, the thumbturn 220 is rotatable about the first longitudinal axis 102 and is rotationally coupled with the driving tailpiece 120. While the exterior manual actuator of the illustrated embodiment is provided in the form of a thumbturn 220, it is also contemplated that the exterior manual actuator may be provided in another form, such as that of a knob or lever.

The lock cylinder 230 is mounted in the second opening 213, and generally includes a shell 232 rotationally coupled with the exterior escutcheon 210, a plug 234 rotatably mounted in the shell 232, and a tumbler system 236 configured to selectively prevent rotation of the plug 234 relative to the shell 232. The tumbler system 236 may be biased toward a blocking state in which the tumbler system 236 prevents rotation of the plug 234 relative to the shell 232. The tumbler system 236 is configured to be actuated by a proper key 239, such that the plug 234 is rotatable upon insertion of the key 239 into the plug 234. While the illustrated lock cylinder 230 includes a tumbler system 236 in the form of a pin tumbler system, it is to be appreciated that additional or alternative forms of tumblers may be utilized, including but not limited to disk tumblers and/or wafer tumblers. The plug 234 is engaged with the driven tailpiece 130 such that rotation of the plug 234 causes a corresponding rotation of the driven tailpiece 130. While other forms are contemplated, in the illustrated embodiment, the plug 234 is rotationally coupled with the driven tailpiece 130 and is rotatable about the second longitudinal axis 103. As described herein, the lock cylinder 230 provides a mechanical override feature that enables a user possessing the proper key 239 to drive the bolt 114 between the extended position and the retracted position. It is also contemplated that the lock cylinder 230 may be omitted, for example in embodiments in which the mechanical override is provided in another form or is not desired.

The credential reader 240 is mounted in the escutcheon 210, and in the illustrated form is provided in the form of a keypad 242 comprising a plurality of keys 244. The keys 244 project through the apertures 214 in the escutcheon 210 such that a user is capable of pressing the keys 243 to enter credential information in the form of a code. The credential reader 240 is configured to receive credential input from a user, and to transmit to a controller 322 of the interior assembly credential information corresponding to the credential input. In the illustrated form, the credential reader 240 receives credential input in the form of a manually-entered code. In other forms, the credential reader 240 may be provided in another form, such as that of a card reader, a biometric reader, a mobile device reader, or another type of credential reader. In such forms, the credential reader 240 may receive credential information of a type other than a manually-inputted code.

As described herein, the credential reader 240 enables a user possessing the proper credential to input the credential information to enable the user to actuate the bolt mechanism 110 by turning the exterior thumbturn 220. While the credential reader 240 of the illustrated embodiment is integrated into the external assembly 200, it is also contemplated that the credential reader 240 may be positioned elsewhere (e.g., on a wall adjacent the door 90). In these embodiments and others, the credential reader 240 may be omitted from the exterior assembly 200.

Figure 4:
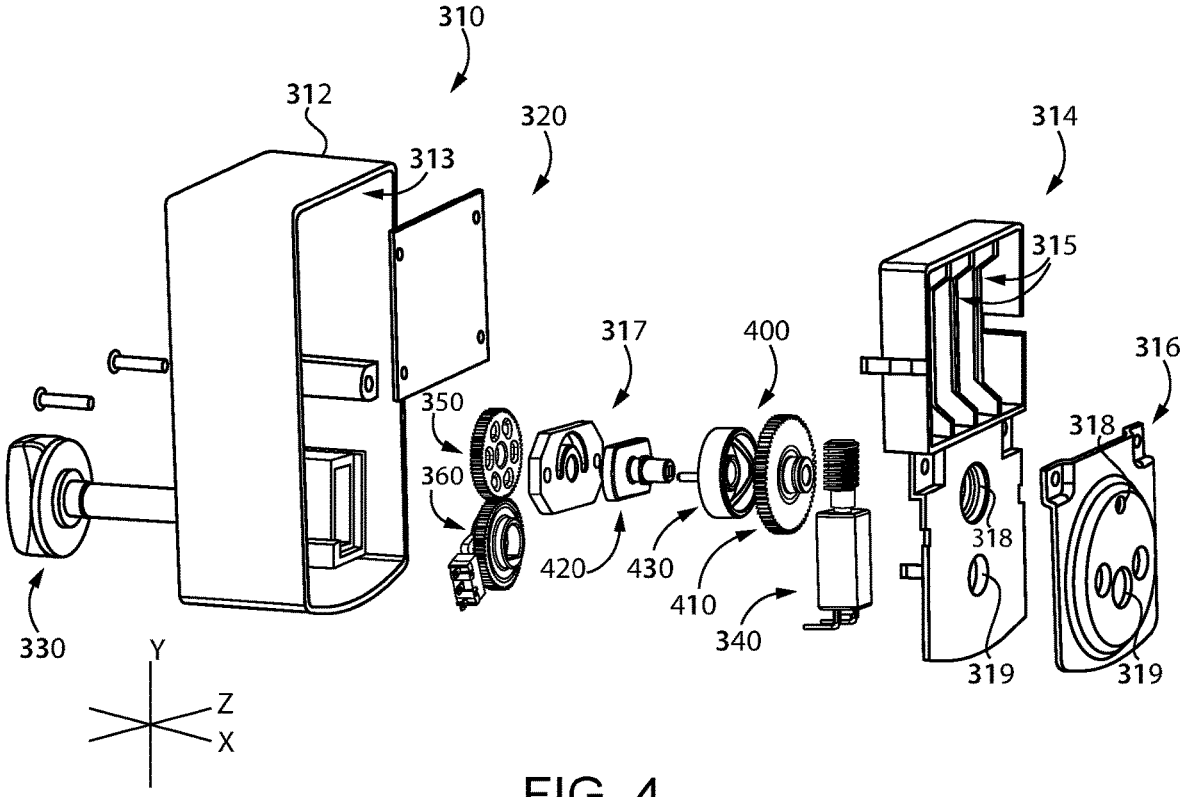
FIG. 4 is an exploded assembly view of an interior assembly of the lockset illustrated in FIG. 1.

With additional reference to FIG. 4, the interior assembly 300 generally includes an interior escutcheon 310, a control assembly 320 mounted in the escutcheon 310, an interior manual actuator in the form of an interior thumbturn 330 rotatably mounted to the escutcheon 310, an electromechanical driver 340 mounted in the escutcheon 310 and in communication with the control assembly 320, a driving gear 350 rotatably mounted in the escutcheon 310, a driven gear 360 rotatably mounted in the escutcheon 310 and engaged with the thumbturn 330 and the driving gear 350, and a clutch 400 engaged with the electromechanical driver 340. The clutch 400 generally includes an input component 410, an output component 420, and a cam member 430 engaged between the input component 410 and the output component 420. As described herein, the clutch 400 has a coupling state in which the output component 420 is rotationally coupled with the driving gear 350 and a decoupling state in which the output component 420 is rotationally decoupled from the driving gear 350, and the electromechanical driver 340 is configured to move the clutch 400 between the coupling state and the decoupling state under control of the control assembly 320.

The interior escutcheon 310 generally includes a housing 312 defining a chamber 313 in which various components of the interior assembly 300 are seated, a battery housing 314 including channels 315 for housing batteries or another form of energy storage device, a mounting plate 316 configured for mounting to the interior side 93 of the door 90, and a holder plate 317 that supports the clutch 400. Each of the battery housing 314 and the mounting plate 316 includes a first opening 318 through which the driving tailpiece 120 extends, and a second opening 319 through which the driven tailpiece 130 extends.

Figure 5:
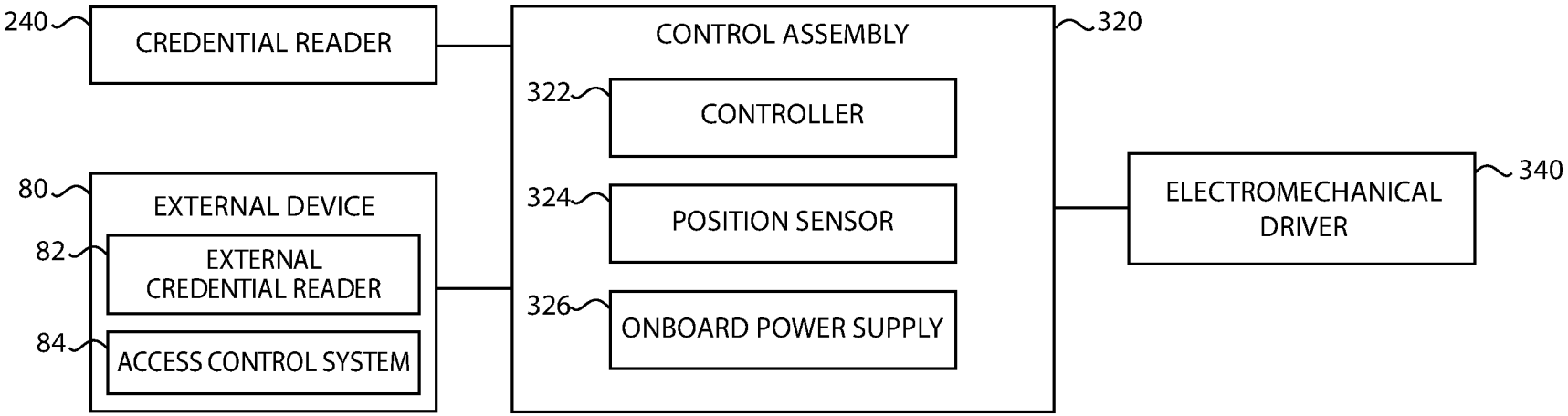
FIG. 5 is a schematic block diagram of a portion of the lockset illustrated in FIG. 1.

With additional reference to FIG. 5, the control assembly 320 generally includes a controller 322, and may further include a position sensor 324 and/or an onboard power supply 326. The control assembly 320 is in communication with the credential reader 240 and the electromechanical driver 340, and as described herein, is configured to control operation of the electromechanical driver 340 based upon information received from the credential reader 240 and/or an external device 80, such as an external credential reader 82 and/or an access control system 84.

The position sensor 324 is associated with one of the driving gear 350 or the driven gear 360, and the controller 322 is operable to determine the extended/retracted position of the bolt 114 based upon information received from the position sensor 324. While the illustrated position sensor 324 is provided in the form of a mechanical switch including an armature 325, it is to be appreciated that other forms of sensors may be utilized, such as optical sensors, magnetic sensors, rotary encoders, and the like.

The onboard power supply 326 is operable to provide electrical power that can be used by the controller 322 to drive the electromechanical driver 340, and in the illustrated form comprises one or more batteries 327 that are mounted in the channels 315 of the battery holder 314. It is also contemplated that the onboard power supply 326 may additionally or alternatively include energy storage devices of another type, such as supercapacitors. It is further contemplated that the onboard power supply 326 may be omitted, such as in embodiments in which the control assembly 320 is connected to line power.

The interior thumbturn 330 is rotatably mounted to the interior escutcheon 310 and is engaged with the driven tailpiece 130 and the driven gear 360 such that rotation of the thumbturn 330 is correlated with rotation of the driven tailpiece 130 and rotation of the driven gear 360. In the illustrated form, the thumbturn 330 includes a stem 332 that defines an opening 333 and a flat 334. The opening 333 receives the end of the driven tailpiece 130 such that the interior thumbturn 330 and the driven tailpiece 130 are rotationally coupled with one another, and the flat 334 engages a corresponding flat 364 on the driven gear such that the thumbturn 330 and the driven gear 360 are rotationally coupled with one another. Thus, while other forms are contemplated, in the illustrated embodiment, the driven tailpiece 130, the interior thumbturn 330, and the driven gear 360, are coupled for joint rotation about the second longitudinal axis 103. Furthermore, while the illustrated interior assembly 300 includes an interior manual actuator in the form of an interior thumbturn 330, it is also contemplated that other forms of manual actuator may be utilized, such as a knob or a lever.

Figure 6:
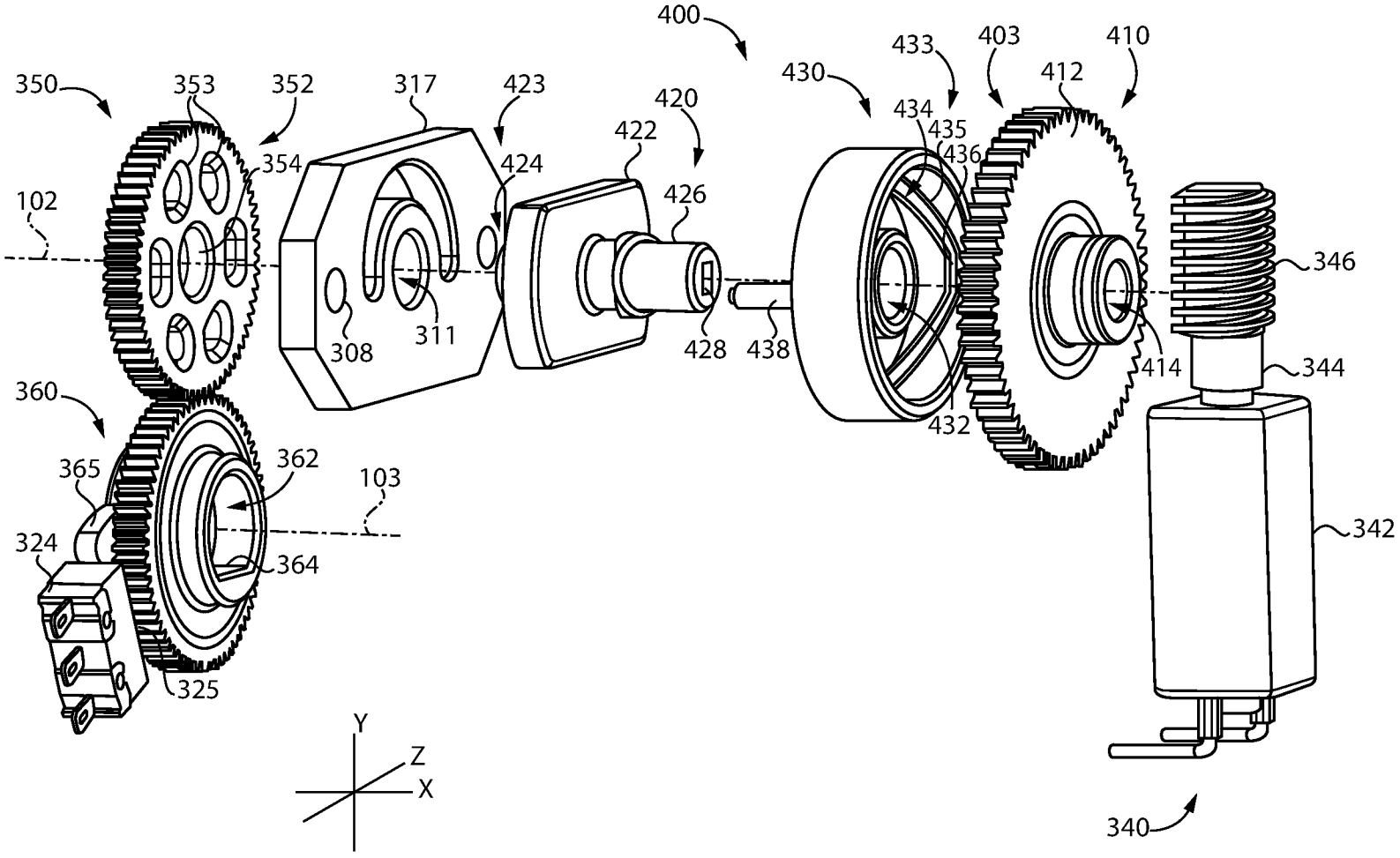
FIG. 6 is an exploded assembly view of a portion of the interior assembly illustrated in FIG. 4.

With additional reference to FIG. 6, the electromechanical driver 340 is engaged with the clutch 400, and is configured to move the clutch 400 between the coupling state and the decoupling state when driven by the control assembly 320. In the illustrated form, the driver 340 is provided in the form of a rotary motor 342 operable to rotate a motor shaft 344 including a worm 346. As described herein, the worm 346 is engaged with the clutch 400 such that rotation of the worm 346 rotates the input component 410 of the clutch 400 to drive the clutch 400 between its coupling state and its decoupling state. It is also contemplated that the motor 342 may rotate the input component 410 via an interface that does not include a worm 346. Furthermore, while the illustrated driver 340 is provided in the form of a rotary motor 342, it is also contemplated that the driver 340 may take another form, such as that of a solenoid.

The driving gear 350 is rotatably mounted in the escutcheon 310 for rotation about the first longitudinal axis 102, and includes a coupling feature 352 by which the driving gear 350 can engage the output component 420. In the illustrated form, the coupling feature 352 is provided in the form of a plurality of apertures 353, each of which is operable to receive a projection of the output component 420. Additionally or alternatively, a central opening 354 of the driving gear 350 may be sized and shaped for rotational coupling with a front post 424 of the output component 420.

The driven gear 360 is rotatably mounted is rotatably mounted in the escutcheon 310 for rotation about the second longitudinal axis 103, and includes an opening 362 through which the stem 332 of the thumbturn 330 extends. As noted above, the driven gear 360 is rotationally coupled with the interior thumbturn 330 via flats 334, 364, and is rotationally coupled with the driven tailpiece 130 via the stem 332. The driven gear 360 has a first position corresponding to the extended position of the bolt 114 and a second position corresponding to the retracted position of the bolt 114. The driven gear 360 may further include a lobe 365 that interfaces with the position sensor 324 by depressing and releasing the armature 325 as the driven gear 360 rotates between the first position and the second position such that the output of the sensor 324 corresponds to the extended/retracted position of the bolt 114. It is also contemplated that the lobe 365 may actuate the sensor 324 in another manner, for example by blocking and unblocking an optical path sensed by an optical embodiment of the sensor 324 and/or altering a magnetic field sensed by a magnetic version of the sensor 324. Furthermore, while the lobe 365 of the illustrated embodiment is formed on the driven gear 360, it is also contemplated that a similar sensor interface may be formed on the driving gear 350, such as in embodiments in which the sensor 324 is associated with the driving gear 350.

As noted above, the illustrated clutch 400 generally includes an input component 410, an output component 420, and a cam member 430 engaged between the input component 410 and the output component 410. The clutch 400 may further include a biasing member 440 urging the cam member 430 into engagement with the input component 410. As also noted above, the clutch 400 has a coupling state and a decoupling state, and is configured to move between the coupling state and the decoupling state in response to actuation of the electromechanical driver 340. In the coupling state, the output component 420 is in a coupling position in which the output component 420 is rotationally coupled with the driving gear 350. In the decoupling state, the output component 420 is in a decoupling position in which the output component 420 is rotationally decoupled from the driving gear 350.

In the illustrated embodiment, the input component 410 is provided in the form of a main gear 412 that is engaged with the worm 346 such that rotation of the worm 346 about a lateral axis causes a corresponding rotation of the main gear 412 about the first longitudinal axis 102. The main gear 412 includes a central opening 414 through which the driving tailpiece 120 extends without forming a rotational coupling between the main gear 412 and the driving tailpiece 120. As a result, the main gear 412 and the driving tailpiece 120 remain rotationally decoupled from one another. The main gear 412 also includes a projection 416 (FIG. 2) that, as described herein, interfaces with the cam member 430 to drive the output component 420 between its coupling and decoupling positions.

The output component 420 generally includes a body portion 422, a front post 424 projecting toward the driving gear 350, a rear post 426 projecting toward the cam member 430, and an aperture 428 extending through at least a portion of the rear post 426. In certain embodiments, the output component 420 may further include an additional post that projects substantially parallel to the front post 424. The front post 424 extends into an opening 311 in the holder plate 317 and the rear post 426 extends into an opening 432 in the cam member 430 such that the output component 420 is rotatably supported between the holder plate 317 and the cam member 430.

The output component 420 has a forward coupling position in which the output component 420 is rotationally coupled with the driving gear 350, and a rearward decoupling position in which the output component 420 is rotationally decoupled from the driving gear 350. The output component 420 includes an engagement feature 423 configured to engage the engagement feature 353 of the driving gear 350. The engagement feature 423 may be defined by the front post 424 and/or by the additional post. In certain embodiments, the front post 424 has a non-circular cross-section, and the central opening 354 of the driving gear 350 has a correspondingly-shaped non-circular cross-section such that the driving gear 350 and the output component 420 rotationally couple with one another when the output component 420 is in the coupling position. Additionally or alternatively, the additional post may enter one of the apertures 353 when the output component 420 is in the coupling position.

The aperture 428 extends at least partially through the rear post 426, and is sized and shaped for rotational coupling with the driving tailpiece 120. The driving tailpiece 120 extends into the aperture 428 such that the driving tailpiece 120 and the output component 420 are rotationally coupled with one another, while permitting the output component 420 to slide axially along the driving tailpiece 120. As a result, the output component 420 rotationally couples the driving tailpiece 120 and the driving gear 350 when the output component 420 is in the coupling position, and rotationally decouples the driving tailpiece 120 from the driving gear 350 when the output component 420 is in the decoupling position. Accordingly, the output component 420 may alternatively be referred to as a coupler in certain embodiments.

The cam member 430 is rotatable about the first longitudinal axis 102, and generally includes a central opening 432 and a cam surface 433 including a front landing 434, a rear landing 436, and a ramp 435 extending between and connecting the landings 434, 436. The rear post 426 extends into the central opening 432 such that the cam member 430 rotatably supports the output component 420 while permitting relative rotation of the output component 420 and the cam member 430. As described herein, the cam surface 433 engages the projection 416 to facilitate longitudinal movement of the cam member 430 in response to rotation of the input component 410. Accordingly, the cam surface 433 and the projection 416 together are one example of a cam interface 403 that may be used to drive the output component 420 between its coupling and decoupling positions. The cam member 430 may be engaged with the interior escutcheon 310 such that rotation of the cam member 430 is prevented. For example, the cam member 430 may include a post 438 that extends into an opening 308 in the holder plate 317 to rotationally couple the cam member 430 with the holder plate 317.

The biasing member 440 is engaged between the holder plate 317 and the output component 420 and urges the output component 420 toward its decoupling position and into engagement with the cam member 430. In the illustrated form, the biasing member 440 is provided in the form of a compression spring that is mounted to the front post 424 between the holder plate 317 and the body 422 of the output component 420. It is also contemplated that the biasing member 440 may take another form, such as that of a torsion spring, an extension spring, a leaf spring, an elastic member, or magnets.

Figure 7:
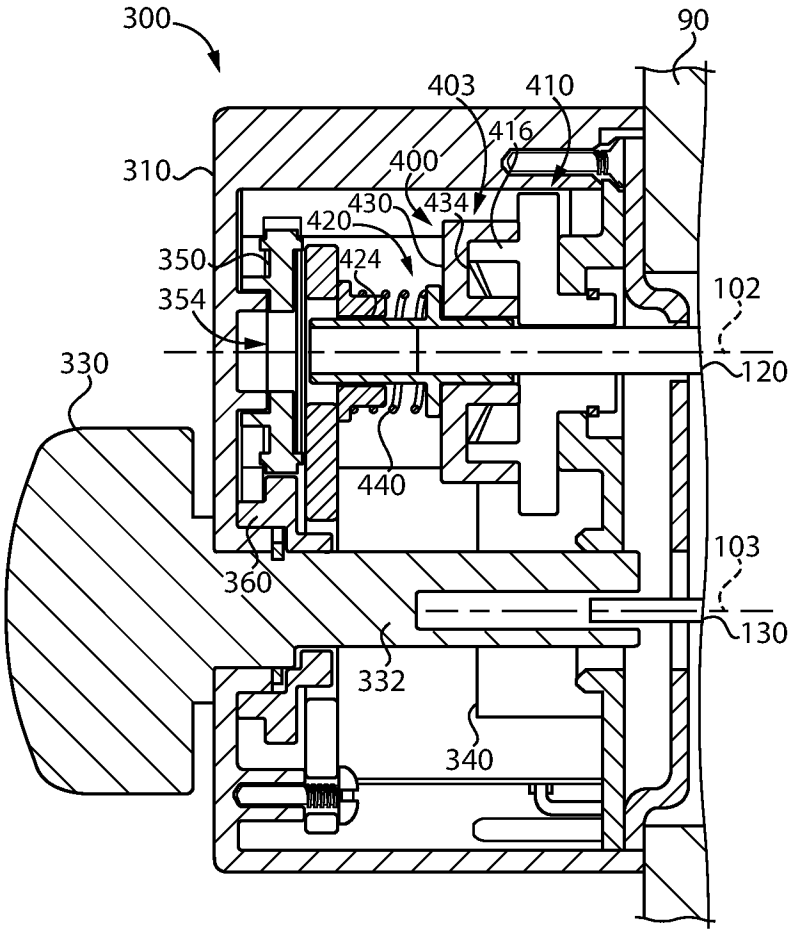
FIG. 7 is a cross-sectional view of the interior assembly illustrated in FIG. 4 with a clutch in a decoupling state.

With additional reference to FIG. 7, illustrated therein is the interior assembly 300 with the clutch 400 in the decoupling state. In this state, the projection 416 of the input component 410 is engaged with the forward landing 434 of the cam surface 433. With the biasing member 440 urging the output component 420 and the cam member 430 rearward, the output component 420 and the cam member 430 adopt rearward positions. With the output component 420 in the rearward decoupling position, the engagement features 352, 423 are disengaged with one another to rotationally decouple the driving gear 350 from the output component 420. As a result, the driving tailpiece 120, which rotates with the exterior thumbturn 330 and the output component 420, is rotationally decoupled from the driving gear 350, rotation of which actuates the bolt mechanism 110. Thus, the clutch 400 in the decoupling state decouples the exterior thumbturn 220 and the driving tailpiece 120 from the driven tailpiece 130 and the bolt mechanism 110 such that the thumbturn 220 is inoperable to actuate the bolt mechanism 110.

It should be noted that while the clutch 400 is in the decoupling state, each of the interior thumbturn 330 and the lock cylinder 230 remain connected with the driven tailpiece 130, and thus remain operable to actuate the bolt mechanism 110. The driven tailpiece 130 may be connected with the plug 234 via a lost rotational motion connection such that the interior thumbturn 330 remains free to actuate the bolt mechanism 110 without requiring rotation of the plug 234 relative to the shell 232.

Figure 8:
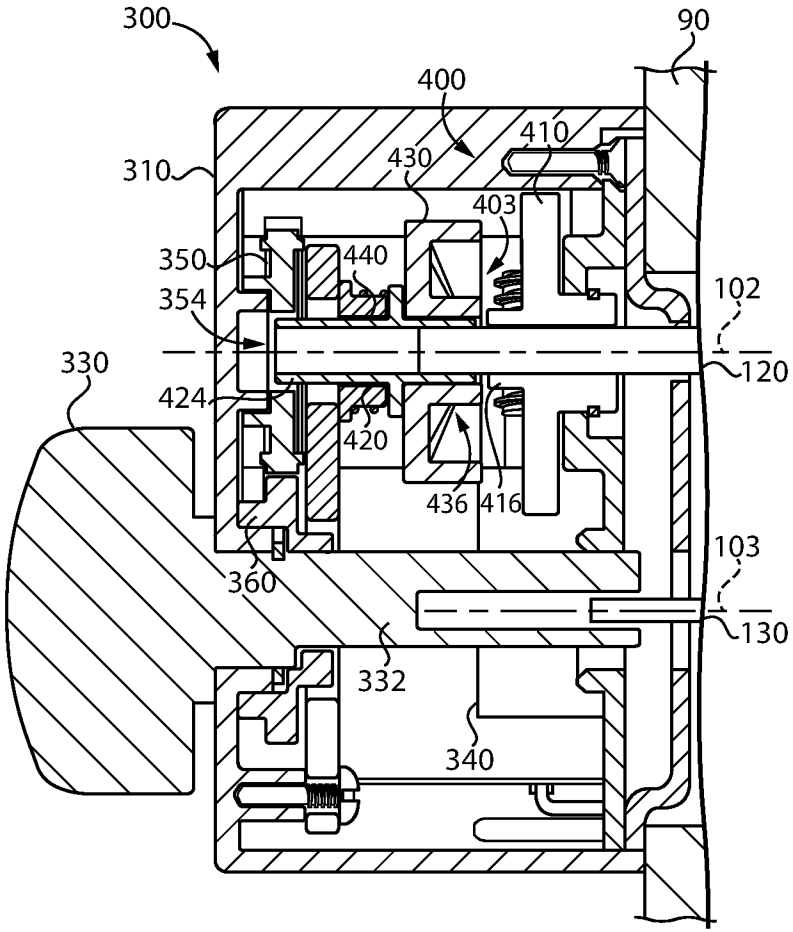
FIG. 8 is a cross-sectional view of the interior assembly illustrated in FIG. 4 with the clutch in a coupling state.

With additional reference to FIG. 8, illustrated therein is the interior assembly 300 with the clutch 400 in the coupling state. In this state, the projection 416 of the input component 410 is engaged with the rearward landing 436 of the cam surface 433 such that the input component 410 holds the output component 420 and the cam member 430 in forward positions against the urging of the biasing member 440. With the output component 420 in the forward coupling position, the engagement features 352, 423 are engaged with one another to rotationally couple the driving gear 350 with the output component 420. As a result, the driving tailpiece 120, which rotates with the exterior thumbturn 330 and the output component 420, is rotationally coupled with the driving gear 350, rotation of which actuates the bolt mechanism 110. Thus, the clutch 400 in the coupling state couples the exterior thumbturn 220 and the driving tailpiece 120 with the driven tailpiece 130 and the bolt mechanism 110 such that the thumbturn 220 is operable to actuate the bolt mechanism 110.

In order to transition the clutch 400 from the decoupling state (FIG. 7) to the coupling state (FIG. 8), the electromechanical driver 340 may be actuated by the control assembly 320. Actuation of the driver 340 in a first manner causes the motor 342 to rotate the worm 346 in a first direction, thereby causing a corresponding rotation of the main gear 412. As the main gear 412 rotates, the projection 416 travels along the ramp 435, thereby urging the cam member 430 and the output component 420 forward against the force of the biasing member 440. When the projection 416 comes into engagement with the rearward landing 436, the output component 420 has reached its coupling position, and rotation of the motor 342 is ceased.

In order to transition the clutch 400 from the coupling state (FIG. 8) to the decoupling state (FIG. 7), the electromechanical driver 340 may be actuated by the control assembly 320. Actuation of the driver 340 in a second manner causes the motor 342 to rotate the worm 346 in a second direction opposite the first direction, thereby causing a corresponding rotation of the main gear 412 in a corresponding direction. As the main gear 412 rotates, the projection 416 travels along the ramp 435 as the biasing member 440 urges the output component 420 and the cam member 430 rearward. When the projection 416 comes into engagement with the forward landing 434, the output component 420 has reached its decoupling position, and rotation of the motor 342 is ceased.

As noted above, rotation of the motor 342 is ceased when the output component 420 reaches its coupling position or its decoupling position. In certain embodiments, the control assembly 320 may include an additional sensor that senses the coupling/decoupling position of the output component, and the controller 322 may cease operation of the motor 342 based upon information received from the additional sensor. Alternatively, the controller 322 may operate the motor 342 for a predetermined period of time known to be sufficient to drive the output component 420 between its coupling position and its decoupling position. In certain embodiments, such as those in which the motor 342 is provided in the form of a stepper motor, the controller 322 may operate the motor 342 for a predetermined number of steps known to be sufficient to drive the output component 420 between its coupling position and its decoupling position. It is also contemplated that other forms of control may be utilized.

In the illustrated form, rotation of the input component 410 causes longitudinal movement of output component 420 via the cam interface 403. It is also contemplated that the driver 340 may directly drive the output component 420 between the coupling position and the decoupling position, for example in embodiments in which the driver 340 is provided in the form of a linear actuator.

Figure 9:
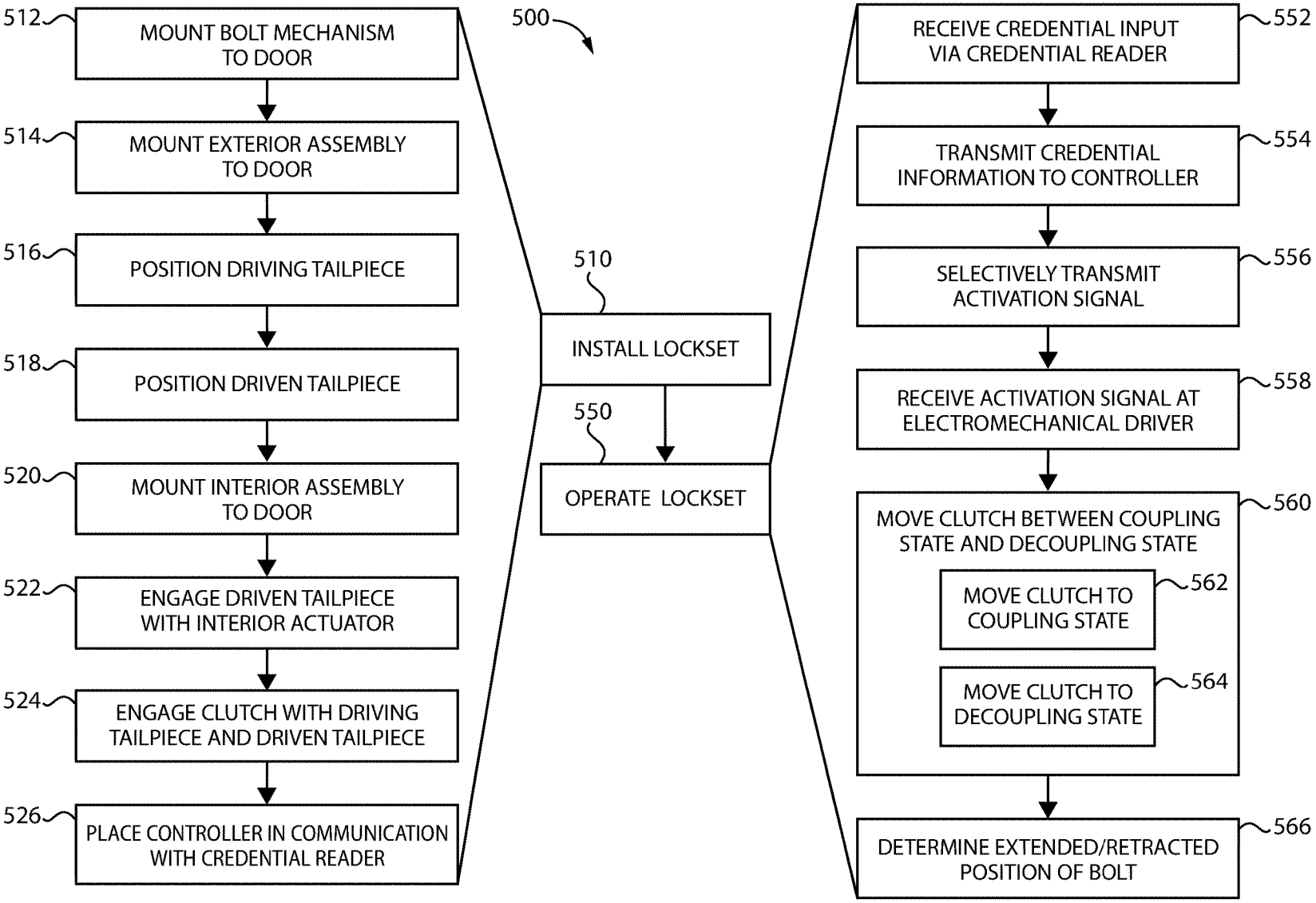
FIG. 9 is a schematic flow diagram of a process according to certain embodiments.

With additional reference to FIG. 9, illustrated therein is an exemplary process 500 that may be performed to install the lockset 100 on the door 90 and/or operate the lockset 100. Blocks illustrated for the processes in the present application are understood to be examples only, and blocks may be combined or divided, and added or removed, as well as re-ordered in whole or in part, unless explicitly stated to the contrary. Unless specified to the contrary, it is contemplated that certain blocks performed in the process 500 may be performed wholly by the credential reader 240, the control assembly 320, the electromechanical driver 340, and/or an external device 80, or that the blocks may be distributed among one or more of the elements and/or additional devices or systems that are not specifically illustrated in FIGS. 1-8. Additionally, while the blocks are illustrated in a relatively serial fashion, it is to be understood that two or more of the blocks may be performed concurrently or in parallel with one another. Furthermore, while the process 500 is described with specific reference to the lockset 100 illustrated in FIGS. 1-8, it is to be appreciated that the process 500 may be performed using locksets having additional or alternative features.

The process 500 generally includes an installation procedure 510 and an operation procedure 550. As described herein, the installation procedure 510 generally involves installing the lockset 100 to the door 90, and the operation procedure 550 generally involves operating an installed lockset 100.

The process 500 may begin with an installation procedure 510, which generally involves installing the lockset 100 to the door 90. The installation procedure 510 includes block 512, which generally involves mounting a bolt mechanism in the door 90, the bolt mechanism including a bolt having an extended position and a retracted position. For example, block 510 may involve inserting the bolt mechanism 110 into the latch bore such that a portion of the bolt mechanism 110 projects into the cross-bore 95.

The installation procedure 510 may further include block 514, which generally involves mounting an exterior assembly including an exterior manual actuator to an exterior side of the door. For example, block 514 may involve mounting the exterior assembly 200 to the exterior side 92 of the door 90. In certain embodiments, the exterior assembly 200 may further include a lock cylinder 230 and/or a credential reader 240.

The installation procedure 510 may further include block 516, which generally involves positioning a driving tailpiece such that the driving tailpiece is operably coupled with the exterior manual actuator and extends through the door. For example, block 516 may involve positioning the driving tailpiece 120 such that the driving tailpiece 120 is operably coupled with the exterior manual actuator 220 and extends through the cross-bore 95 of the door 90 without operably engaging the bolt mechanism 110. With the driving tailpiece 120 so installed, the driving tailpiece 120 may extend generally along the first longitudinal axis 102. In certain embodiments, the driving tailpiece 120 may be pre-installed to the exterior thumbturn 220, such that block 516 is performed at least partly during manufacture of the exterior assembly 200.

The installation procedure 510 may further include block 518, which generally involves positioning a driven tailpiece in engagement with the bolt mechanism such that rotation of the driven tailpiece drives the bolt between the extended position and the retracted position. For example, block 518 may involve passing the driven tailpiece 130 through the retractor 116 such that the bolt mechanism 110 extends and retracts the bolt 114 in response to rotation of the driven tailpiece 130. In certain embodiments, the driven tailpiece 130 may be engaged with a lock cylinder 230 such that rotation of the plug 234 through a first predetermined angle causes rotation of the driven tailpiece 130 through a second predetermined angle sufficient to drive the bolt 114 between its extended position and its retracted position. With the driven tailpiece 130 installed, the driven tailpiece 130 may extend generally along the second longitudinal axis 103, which is laterally offset from the first longitudinal axis 102.

The installation procedure 510 may further include block 520, which generally involves mounting an interior assembly including a clutch to an interior side of the door opposite the exterior side of the door. For example, block 520 may involve mounting the interior assembly 300 including the clutch 400 to the interior side 93 of the door 90.

The installation procedure 510 may further include block 522, which generally involves engaging the driven tailpiece with an interior manual actuator of the interior assembly. For example, in embodiments in which the interior assembly 300 includes an interior manual actuator such as the interior thumbturn 330, block 522 may involve inserting the free end of the driven tailpiece 130 into the aperture 333 of the stem 332 such that the driven tailpiece 130 and the thumbturn 330 are rotationally coupled.

The installation procedure 510 may further include block 524, which generally involves engaging the clutch with the driving tailpiece and the driven tailpiece such that the clutch is operable to selectively couple the driving tailpiece with the driven tailpiece. For example, block 524 may involve engaging the clutch 400 with the driving tailpiece 120 and the driven tailpiece 130. In the illustrated form, block 524 involves inserting the free end of the driving tailpiece 120 into the aperture 428 of the output component 420 such that the output component 420 is rotationally coupled with the driving tailpiece 120 and is operable to slide along the first longitudinal axis 102. Upon completion of block 524, the clutch 400 is engaged with both the driving tailpiece 120 and the driven tailpiece 130. In the illustrated form, the clutch 400 is directly engaged with the driving tailpiece 120 and is indirectly engaged with the driven tailpiece 130 via the driving gear 350, the driven gear 360, and the interior thumbturn 330. It is also contemplated that the clutch 400 may be indirectly engaged with the driving tailpiece 120 and/or directly engaged with the driven tailpiece 130.

The installation procedure 510 may further include block 526, which generally involves placing a control assembly of the interior assembly in communication with a credential reader and/or an external device. For example, in embodiments in which the exterior assembly 200 includes an integrated credential reader 240, block 526 may involve placing the control assembly 320 in communication with the credential reader 240 via wires running through the cross-bore 95, or via a pair of wireless communication devices. It is also contemplated that block 526 may involve placing the control assembly 320 in wired or wireless communication with an external device 80, such as a non-integrated credential reader 82 and/or an access control system 84.

As noted above, the process 500 may include an operating procedure 550 in addition to the installation procedure 510. It is also contemplated that the operating procedure 550 may be a standalone process, for example in embodiments in which the lockset is already installed to a door. As described herein, the operating procedure 550 generally involves operating the installed lockset by selectively moving the clutch between a coupling state and a decoupling state.

The operating procedure 550 may begin with block 552, which generally involves receiving a credential input via a credential reader. In the illustrated form, block 552 involves receiving a code input via the integrated pushbutton credential reader 240. It is also contemplated that block 552 may involve receiving the credential input via another form of integrated credential reader, such as a card reader, a biometric reader, a mobile device reader, or another form of credential reader. Furthermore, while the illustrated embodiment involves receiving the credential input via the integrated credential reader 240 of the exterior assembly 200, it is also contemplated that the credential input may be received by an external credential reader 82.

The operating procedure 550 may further include block 554, which generally involves transmitting credential information relating to the credential input from the credential reader to a controller. In the illustrated form, block 554 involves transmitting the credential information from the integrated credential reader 240 to the integrated control assembly 320. It is also contemplated that the credential information may be transmitted from an external credential reader 82 and/or to an external control assembly such as the access control system 84.

The operating procedure 550 may further include block 556, which generally involves selectively transmitting, by the controller and based on the information relating to the credential input, an activation signal. Block 556 may, for example, involve comparing the credential information received in block 554 to authorized credential information, and transmitting the activation signal only when the received credential information matches authorized credential information. In the illustrated form, block 556 is performed at least in part by the integrated control assembly 320. It is also contemplated that block 556 may be performed at least in part by an external control assembly, such as one of the access control system 84.

The operating procedure 550 may further include block 558, which generally involves receiving the activation signal at an electromechanical driver of the interior assembly. In the illustrated form, block 558 involves receiving the activation signal at an electromechanical driver 340 in the form of a rotary motor 342. It is also contemplated that block 558 may involve receiving the activation signal at another form of electromechanical driver, such as a rotary solenoid, a linear solenoid, or a linear motor.

The operating procedure 550 may further include block 560, which generally involves moving the clutch between the decoupling state and the coupling state. The moving of block 560 may be performed by the electromechanical driver and in response to receiving the activation signal. In the illustrated form, block 560 generally involves operating the motor 342 to drive the worm 346 to rotate the input component 410, which in turn moves the output component 420 between the coupling position and the decoupling position to operably connect and disconnect the driving tailpiece 120 and the driven tailpiece 130 as described above.

In certain embodiments, block 560 may include block 562, which involves moving the clutch 400 from the decoupling state to the coupling state. In the illustrated form, block 562 generally involves operating the motor 342 to drive the worm 346 to rotate the input component 410 in a first direction, which in turn moves the output component 420 to the coupling position to operably connect the driving tailpiece 120 with the driven tailpiece 130 as described above. In certain embodiments, block 562 may involve operating the motor 342 for a predetermined period of time. In embodiments in which the motor 342 is provided as a stepping motor, block 562 may involve operating the motor 342 for a predetermined number of steps. Upon completion of block 562, the exterior thumbturn 220 is operable to rotate the driven tailpiece 130 to drive the bolt 114 between its extended and retracted positions.

In addition or as an alternative to moving the clutch from the decoupling state to the coupling state in block 562, block 560 may include block 564, which generally involves moving the clutch from the coupling state to the decoupling state. In the illustrated form, block 564 generally involves operating the motor 342 to drive the worm 346 to rotate the input component 410 in a second direction opposite the first direction, which in turn moves the output component 420 to the decoupling position and operably disconnects the driving tailpiece 120 from the driven tailpiece 130 as described above. In certain embodiments, block 564 may involve operating the motor 342 for a predetermined period of time. In embodiments in which the motor 342 is provided as a stepping motor, block 564 may involve operating the motor 342 for a predetermined number of steps. Upon completion of block 564, the exterior thumbturn 220 is inoperable to rotate the driven tailpiece 130, and therefore cannot drive the bolt 114 between its extended and retracted positions.

In the illustrated form, block 560 generally involves operating the motor for a predetermined period of time or for a predetermined number of steps to move the clutch 400 between its coupling state and its decoupling state. It is also contemplated that other criteria may be utilized to determine when to stop operation of the motor 342. For example, the control assembly 320 may include a position sensor operable to detect the coupled/uncoupled position of the output component 420, and may terminate operation of the motor 342 when information from the position sensor indicates that the output component 420 has reached the desired one of the coupling positon or the decoupling position. Additionally, while the illustrated embodiment involves operating a motor 342, it is also contemplated that block 560 may involve operating a solenoid to drive the clutch 400 between its coupling and decoupling states.

The operating procedure 550 may further include block 566, which generally involves determining the extended/retracted position of the bolt 114. In the illustrated embodiment, block 566 generally involves determining the extended/retracted position of the bolt 114 based upon output from the position sensor 324. For example, the lobe 365 may be positioned such that the lobe 365 depresses the armature 325 when the bolt 114 is in its extended position. In such forms, the output of the sensor 324 when the armature 325 is depressed may be taken as indicative of the extended position of the bolt, and the output of the sensor 324 when the armature 325 is extended may be taken as indicative of the retracted position of the bolt 114. Alternatively, the lobe 365 may be positioned such that the lobe 365 depresses the armature 325 when the bolt 114 is in its retracted position, and the output of the sensor 324 when the armature 325 is depressed may be taken as indicative of the retracted position of the bolt 114. Those skilled in the art will readily appreciate that in embodiments in which the sensor 324 is provided in a form other than a snap action mechanical switch (e.g., as an optical sensor, a magnetic sensor, or an inductive sensor), the output of the sensor 324 may nonetheless correspond to the position of the lobe 365. Furthermore, while the sensor 324 of the illustrated embodiment is associated with the driven gear 360, it should be appreciated that a sensor may additionally or alternatively be associated with the driving gear 350 to determine the extended/retracted position of the bolt 114.

Figure 10:
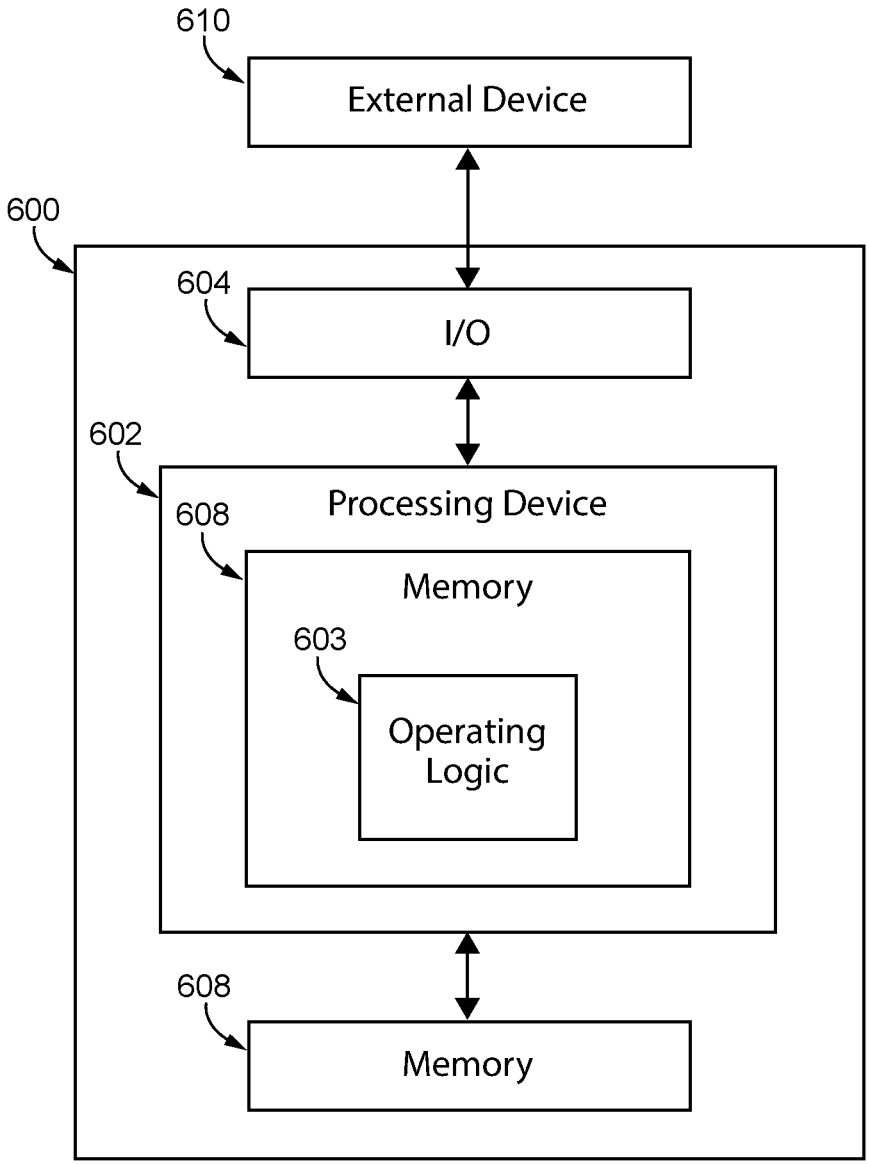
FIG. 10 is a schematic block diagram of a computing device that may be utilized in connection with certain embodiments.

Referring now to FIG. 10, a simplified block diagram of at least one embodiment of a computing device 600 is shown. The illustrative computing device 600 depicts at least one embodiment of a controller or credential reader that may be utilized in connection with the controller 322 and credential readers 82, 240 illustrated in FIGS. 1-8.

Depending on the particular embodiment, the computing device 600 may be embodied as a server, desktop computer, laptop computer, tablet computer, notebook, netbook, Ultrabook™ mobile computing device, cellular phone, smartphone, wearable computing device, personal digital assistant, Internet of Things (IoT) device, reader device, access control device, control panel, processing system, router, gateway, and/or any other computing, processing, and/or communication device capable of performing the functions described herein.

The computing device 600 includes a processing device 602 that executes algorithms and/or processes data in accordance with operating logic 608, an input/output device 604 that enables communication between the computing device 600 and one or more external devices 610, and memory 606 which stores, for example, data received from the external device 610 via the input/output device 604.

The input/output device 604 allows the computing device 600 to communicate with the external device 610. For example, the input/output device 604 may include a transceiver, a network adapter, a network card, an interface, one or more communication ports (e.g., a USB port, serial port, parallel port, an analog port, a digital port, VGA, DVI, HDMI, FireWire, CAT 5, or any other type of communication port or interface), and/or other communication circuitry. Communication circuitry may be configured to use any one or more communication technologies (e.g., wireless or wired communications) and associated protocols (e.g., Ethernet, Bluetooth®, Bluetooth Low Energy (BLE), WiMAX, etc.) to effect such communication depending on the particular computing device 600. The input/output device 604 may include hardware, software, and/or firmware suitable for performing the techniques described herein.

The external device 610 may be any type of device that allows data to be inputted or outputted from the computing device 600. For example, in various embodiments, the external device 610 may be embodied as the external device 80 (e.g., a credential reader 82 or an access control system 84), the credential reader 240, the controller 322, the position sensor 324, or the electromechanical driver 340. Further, in some embodiments, the external device 610 may be embodied as another computing device, switch, diagnostic tool, controller, printer, display, alarm, peripheral device (e.g., keyboard, mouse, touch screen display, etc.), and/or any other computing, processing, and/or communication device capable of performing the functions described herein. Furthermore, in some embodiments, it should be appreciated that the external device 610 may be integrated into the computing device 600.

The processing device 602 may be embodied as any type of processor(s) capable of performing the functions described herein. In particular, the processing device 602 may be embodied as one or more single or multi-core processors, microcontrollers, or other processor or processing/controlling circuits. For example, in some embodiments, the processing device 602 may include or be embodied as an arithmetic logic unit (ALU), central processing unit (CPU), digital signal processor (DSP), and/or another suitable processor(s). The processing device 602 may be a programmable type, a dedicated hardwired state machine, or a combination thereof. Processing devices 602 with multiple processing units may utilize distributed, pipelined, and/or parallel processing in various embodiments. Further, the processing device 602 may be dedicated to performance of just the operations described herein, or may be utilized in one or more additional applications. In the illustrative embodiment, the processing device 602 is of a programmable variety that executes algorithms and/or processes data in accordance with operating logic 608 as defined by programming instructions (such as software or firmware) stored in memory 606. Additionally or alternatively, the operating logic 608 for processing device 602 may be at least partially defined by hardwired logic or other hardware. Further, the processing device 602 may include one or more components of any type suitable to process the signals received from input/output device 604 or from other components or devices and to provide desired output signals. Such components may include digital circuitry, analog circuitry, or a combination thereof.

The memory 606 may be of one or more types of non-transitory computer-readable media, such as a solid-state memory, electromagnetic memory, optical memory, or a combination thereof. Furthermore, the memory 606 may be volatile and/or nonvolatile and, in some embodiments, some or all of the memory 606 may be of a portable variety, such as a disk, tape, memory stick, cartridge, and/or other suitable portable memory. In operation, the memory 606 may store various data and software used during operation of the computing device 600 such as operating systems, applications, programs, libraries, and drivers. It should be appreciated that the memory 606 may store data that is manipulated by the operating logic 608 of processing device 602, such as, for example, data representative of signals received from and/or sent to the input/output device 604 in addition to or in lieu of storing programming instructions defining operating logic 608. As illustrated, the memory 606 may be included with the processing device 602 and/or coupled to the processing device 602 depending on the particular embodiment. For example, in some embodiments, the processing device 602, the memory 606, and/or other components of the computing device 600 may form a portion of a system-on-a-chip (SoC) and be incorporated on a single integrated circuit chip.

In some embodiments, various components of the computing device 600 (e.g., the processing device 602 and the memory 606) may be communicatively coupled via an input/output subsystem, which may be embodied as circuitry and/or components to facilitate input/output operations with the processing device 602, the memory 606, and other components of the computing device 600. For example, the input/output subsystem may be embodied as, or otherwise include, memory controller hubs, input/output control hubs, firmware devices, communication links (i.e., point-to-point links, bus links, wires, cables, light guides, printed circuit board traces, etc.) and/or other components and subsystems to facilitate the input/output operations.

The computing device 600 may include other or additional components, such as those commonly found in a typical computing device (e.g., various input/output devices and/or other components), in other embodiments. It should be further appreciated that one or more of the components of the computing device 600 described herein may be distributed across multiple computing devices. In other words, the techniques described herein may be employed by a computing system that includes one or more computing devices. Additionally, although only a single processing device 602, I/O device 604, and memory 606 are illustratively shown in FIG. 10, it should be appreciated that a particular computing device 600 may include multiple processing devices 602, I/O devices 604, and/or memories 606 in other embodiments. Further, in some embodiments, more than one external device 610 may be in communication with the computing device 600.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lockset configured for mounting to a door having an exterior side, an interior side, and a free edge extending between and connecting the exterior side and the interior side, the lockset comprising:

a bolt mechanism configured for mounting within the door and comprising a bolt having an extended position and a retracted position;

an exterior assembly configured for mounting to the exterior side of the door, the exterior assembly comprising an exterior escutcheon and an exterior manual actuator rotatably mounted to the exterior escutcheon;

an interior assembly configured for mounting to the interior side of the door, the interior assembly comprising an interior escutcheon and a clutch mounted in the interior escutcheon, the clutch having a coupling state and a decoupling state;

a driving tailpiece connected between the exterior manual actuator and the clutch; and a driven tailpiece connected between the clutch and the bolt such that rotation of the driven tailpiece drives the bolt between the extended and retracted positions;

wherein the clutch, in the coupling state, couples the driving tailpiece with the driven tailpiece such that the exterior manual actuator is operable to drive the bolt between the extended and retracted positions; and wherein the clutch, in the decoupling state, decouples the driving tailpiece from the driven tailpiece such that the exterior manual actuator is inoperable to drive the bolt between the extended and retracted positions.

2. The lockset of claim 1, further comprising:

an electromechanical driver mounted in the interior escutcheon, the electromechanical driver operable to drive the clutch between the coupling position and the decoupling position; and a controller mounted in the interior escutcheon and in communication with the electromechanical driver;

wherein the controller is configured to operate the electromechanical driver to drive the clutch between the coupling position and the decoupling position based on information received from a credential reader.

3. The lockset of claim 2, wherein the exterior assembly further comprises the credential reader, and wherein the credential reader is mounted in the exterior escutcheon.

4. The lockset of claim 2, wherein the electromechanical driver comprises a rotary motor.

5. The lockset of claim 4, wherein the clutch comprises:

a main gear engaged with the rotary motor via a worm gear such that rotation of the worm gear by the rotary motor rotates the main gear; and a coupler engaged with the main gear via a cam interface such that rotation of the main gear linearly drives the coupler between a coupling position corresponding to the coupling state and a decoupling position corresponding to the decoupling state;

wherein the coupler in the coupling position operably connects the driving tailpiece with the driven tailpiece; and wherein the coupler in the decoupling position operably disconnects the driving tailpiece from the driven tailpiece.

6. The lockset of claim 1, wherein the exterior assembly further comprises a lock cylinder, and wherein the lock cylinder is engaged with the driven tailpiece such that the lock cylinder is operable to rotate the driven tailpiece to drive the bolt between the extended and retracted positions.

7. The lockset of claim 1, wherein the interior assembly further comprises an interior manual actuator rotatably mounted to the interior escutcheon, and wherein the interior manual actuator is engaged with the driven tailpiece such that the interior manual actuator is operable to rotate the driven tailpiece to drive the bolt between the extended and retracted positions.

8. The lockset of claim 1, wherein the driving tailpiece extends along a first longitudinal axis;

wherein the driven tailpiece extends along a second longitudinal axis arranged parallel to the first longitudinal axis; and wherein the first longitudinal axis and the second longitudinal axis are laterally offset from one another.

9. The lockset of claim 1, wherein the interior assembly further comprises:

a driving gear rotatably mounted in the interior escutcheon, wherein the driving gear is engaged with the driving tailpiece via the clutch such that the driving tailpiece is operable to rotate the driving gear when the clutch is in the coupling state; and a driven gear rotatably mounted in the interior escutcheon, wherein the driven gear is engaged with the driving gear and the driven tailpiece such that rotation of the driving gear causes a corresponding rotation of the driven tailpiece.

10. The lockset of claim 9, wherein at least one of the driving gear or the driven gear comprises a lobe;

wherein the interior assembly further comprises a switch; and wherein the lobe activates and deactivates the switch as the one of the driving gear or the driven gear moves between a first position corresponding to the extended position of the bolt and a second position corresponding to the retracted position of the bolt.

11. The lockset of claim 9, wherein the interior assembly further comprises a motor having a motor shaft; and wherein the motor shaft is engaged with the clutch such that rotation of the motor shaft causes the clutch to move between the coupling state and the decoupling state.

12. The lockset of claim 11, wherein the clutch comprises:

a main gear engaged with the motor shaft such that the motor is operable to rotate the main gear between a first position and a second position;

a coupler coupled with the driving tailpiece such that the coupler and the driving tailpiece are rotationally coupled with one another and the such that coupler is longitudinally slidable along the driving tailpiece between a coupling position and a decoupling position, wherein the coupler in the coupling position is rotationally coupled with the driving gear, and wherein the coupler in the a decoupling position is rotationally decoupled from the driving gear; and a cam interface configured to longitudinally drive the coupler between the coupling position and the decoupling position in response to rotation of the main gear between the first position and the second position.

13. The lockset of claim 1, further comprising an electromechanical driver positioned in the interior escutcheon;

wherein the clutch comprises a coupler having a coupling position corresponding to the coupling state and a decoupling position corresponding to the decoupling state; and wherein the coupler is rotationally coupled with the driving tailpiece and is configured to slide along the driving tailpiece between the coupling position and the decoupling position.

14. A method, comprising:

mounting a bolt mechanism in a door, the bolt mechanism including a bolt having an extended position and a retracted position;

mounting an exterior assembly to an exterior side of the door, the exterior assembly comprising an exterior manual actuator;

positioning a driving tailpiece such that the driving tailpiece is operably coupled with the exterior manual actuator and extends at least partially through the door;

positioning a driven tailpiece in engagement with the bolt mechanism such that rotation of the driven tailpiece drives the bolt between the extended and retracted positions;

mounting an interior assembly to an interior side of the door, the interior assembly including a clutch;

engaging the clutch with the driving tailpiece and the driven tailpiece such that the clutch is operable to selectively couple the driving tailpiece with the driven tailpiece, the driving tailpiece is connected between the exterior manual actuator and the clutch, the driven tailpiece is connected between the clutch and the bolt, and rotation of the driven tailpiece drives the bolt between the extended position and the retracted position; and selectively moving the clutch between a coupling state and a decoupling state;

wherein the clutch, in the coupling state, operably connects the driving tailpiece with the driven tailpiece such that rotation of the driving tailpiece causes a corresponding rotation of the driven tailpiece, thereby enabling the exterior manual actuator to drive the bolt between the extended and retracted positions; and wherein the clutch, in the decoupling state, operably disconnects the driving tailpiece from the driven tailpiece such that rotation of the exterior manual actuator does not drive the bolt between the extended and retracted positions.

15. The method of claim 14, wherein the interior assembly further comprises an electromechanical driver and a controller;

wherein the electromechanical driver is engaged with the clutch such that the electromechanical driver is operable to drive the clutch between the coupling state and the decoupling state;

wherein the controller is in communication with the electromechanical driver and a credential reader; and wherein the selectively moving the clutch between a coupling state and a decoupling state is performed at least in part by the controller and comprises operating the electromechanical driver based on information received from the credential reader.

16. The method of claim 14, wherein the interior assembly further comprises an electromechanical driver;

wherein the clutch comprises a rotatable component engaged with the electromechanical driver, a longitudinally movable component slidably coupled with the driving tailpiece, and a cam interface between the rotatable component and the longitudinally movable component; and wherein selectively moving the clutch between the coupling state and the decoupling state comprises operating the electromechanical driver to rotate the rotatable component, thereby causing the cam interface to longitudinally drive the longitudinally movable component between a coupling position in which the longitudinally movable component operably connects the driving tailpiece with the driven tailpiece and a decoupling position in which the longitudinally movable component operably disconnects the driving tailpiece from the driven tailpiece.

17. The method of claim 14, further comprising:

receiving, by a credential reader of the exterior assembly, a credential input;

transmitting, from the credential reader to a controller of the interior assembly, information relating to the credential input;

selectively transmitting, by the controller and based on the information relating to the credential input, an activation signal;

receiving, by an electromechanical driver of the interior assembly, the activation signal; and moving, by the electromechanical driver and in response to receiving the activation signal, the clutch between the coupling state and the decoupling state.

18. The method of claim 14, further comprising:

inserting a key into a lock cylinder of the exterior assembly, wherein the lock cylinder includes a plug engaged with the driven tailpiece such that rotation of the plug causes a corresponding rotation of the driven tailpiece; and rotating the key, thereby rotating the plug, thereby rotating the driven tailpiece and driving the bolt between the extended position and the retracted position.

19. The method of claim 14, further comprising rotating an interior manual actuator of the interior assembly; and wherein the interior manual actuator is operably connected with the driven tailpiece such that the interior manual actuator is at all times operable to drive the bolt between the extended and retracted positions.

20. An interior assembly for a lockset, the interior assembly comprising:

an interior escutcheon;

a clutch mounted in the interior escutcheon, the clutch comprising:

an input component rotatable about a first longitudinal axis;

an output component mounted for sliding movement along the first longitudinal axis and for rotation about the first longitudinal axis; and a cam interface configured to longitudinally drive the output component between a coupling position and a decoupling position in response to rotation of the input component;

a driving gear rotatably mounted to the interior escutcheon, wherein the output component in the coupling position is operable to rotate the driving gear, and wherein the output component in the decoupling position is inoperable to rotate the driving gear;

a driven gear rotatably mounted to the interior escutcheon, wherein the driven gear is operably connected with the driving gear such that rotation of the driving gear causes a corresponding rotation of the driven gear;

an interior manual actuator rotatably mounted to the interior escutcheon for rotation about a second longitudinal axis, wherein the interior manual actuator is operably connected with the driven gear such that rotation of the driven gear causes a corresponding rotation of the interior manual actuator; and a driven tailpiece connected between the clutch and a bolt such that rotation of the driven tailpiece drives the bolt between an extended position and a retracted position;

wherein the clutch has a coupling state in which the output component is in the coupling position and the clutch is operable to couple a driving tailpiece with the driven tailpiece such that an exterior manual actuator is operable to drive the bolt between the extended position and the retracted position by rotating the driving tailpiece; and wherein the clutch has a decoupling state in which the output component is in the decoupling position and the clutch decouples the driving tailpiece from the driven tailpiece such that the exterior manual actuator is inoperable to drive the bolt between the extended position and the retracted position.

21. The interior assembly of claim 20, wherein the second longitudinal axis is laterally offset from the first longitudinal axis;

wherein the driving gear is mounted for rotation about the first longitudinal axis; and wherein the driven gear is mounted for rotation about the second longitudinal axis.

22. The interior assembly of claim 20, further comprising:

an electromechanical driver operable to rotate the input component to thereby move the clutch between the coupling state and the decoupling state; and a controller in communication with the electromechanical driver and configured to operate the electromechanical driver based on information received from an external device.

23. A lockset including the interior assembly of claim 20, the lockset further comprising:

an external assembly including the exterior manual actuator;

a bolt mechanism including the bolt;

the driving tailpiece, wherein the driving tailpiece is connected between the exterior manual actuator and the output component; and the driven tailpiece, wherein the driven tailpiece is connected between the interior manual actuator and the bolt mechanism; and wherein the bolt mechanism is configured to drive the bolt between the extended and retracted positions in response to rotation of the driven tailpiece.

24. The lockset of claim 23, wherein the driving tailpiece extends along the first longitudinal axis; and wherein the driven tailpiece extends along the second longitudinal axis.

25. The lockset of claim 23, wherein the interior assembly further comprises a motor and a controller;

wherein the external assembly further comprises a credential reader; and wherein the controller is in communication with the credential reader and the motor and is configured to selectively drive the motor to rotate the input component based upon information received from the credential reader.

* * * * *